US012171356B1

(12) United States Patent
Yoo

(10) Patent No.: US 12,171,356 B1
(45) Date of Patent: Dec. 24, 2024

(54) PACKAGING CONTAINER FOR BREAD AND WINE FOR COMMUNION THAT INCLUDES SANITARY STRUCTURE

(71) Applicant: Hong Seol Yoo, Seoul (KR)

(72) Inventor: Hong Seol Yoo, Seoul (KR)

( * ) Notice: Subject to any disclaimer, the term of this patent is extended or adjusted under 35 U.S.C. 154(b) by 0 days.

(21) Appl. No.: 18/713,319

(22) PCT Filed: Oct. 6, 2023

(86) PCT No.: PCT/KR2023/015383
§ 371 (c)(1),
(2) Date: May 24, 2024

(87) PCT Pub. No.: WO2024/076189
PCT Pub. Date: Apr. 11, 2024

(30) Foreign Application Priority Data

Oct. 7, 2022 (KR) ..... 10-2022-0128462

(51) Int. Cl.
*B65D 81/24* (2006.01)
*A47G 33/00* (2006.01)
(Continued)

(52) U.S. Cl.
CPC ..... *A47G 33/002* (2013.01); *B65D 7/20* (2013.01); *B65D 77/06* (2013.01); *B65D 77/30* (2013.01); *B65D 81/24* (2013.01)

(58) Field of Classification Search
CPC .... B65D 51/28; B65D 77/20; B65D 77/2032; B65D 81/24; B65D 81/32; A47G 33/002
(Continued)

(56) References Cited

U.S. PATENT DOCUMENTS 2,604,976 A * 7/1952 Sarg ..... B65D 3/16 206/541
2,766,796 A * 10/1956 Tupper ..... A47G 23/03 220/523
(Continued)

FOREIGN PATENT DOCUMENTS

JP 09-077052 A 3/1997
JP 2011-162201 A 8/2011
(Continued)

OTHER PUBLICATIONS

Korea Office Action Written decision on Registration dated Sep. 20, 2023 for Korean Patent Application No. 10-2022-0128462.
(Continued)

*Primary Examiner* — Luan K Bui
(74) *Attorney, Agent, or Firm* — Sughrue Mion, PLLC

(57) ABSTRACT

Disclosed is a packaging container for bread and wine for Communion that includes a sanitary structure which includes: a first storage portion which has a structure forming a storage space of a predetermined volume in which wine is able to be stored and having an open upper surface; a second storage portion which is rotatably mounted on the upper surface of the first storage portion; a first sealing film in the form of a transparent thin film that is mounted to seal the upper surface of the second storage portion and made of an elastic material having a predetermined elastic restoring force; a second sealing film in the form of a thin film that is mounted to seal a lower surface of the second storage portion and made of the elastic material having the predetermined elastic restoring force; a first tearing; and a second tearing portion.

4 Claims, 8 Drawing Sheets

(51) Int. Cl.

| | |
|---|---|
| ***B65D 6/08*** | (2006.01) |
| ***B65D 77/06*** | (2006.01) |
| ***B65D 77/08*** | (2006.01) |
| ***B65D 77/30*** | (2006.01) |

(58) Field of Classification Search
USPC ..... 206/19, 217, 541, 812; 215/6; 220/524, 220/916; 426/120, 122–124
See application file for complete search history.

(56) References Cited

U.S. PATENT DOCUMENTS

| | | | | |
|---|---|---|---|---|
| 3,514,029 | A * | 5/1970 | Powell | A47G 33/002 206/217 |
| 4,324,338 | A | 4/1982 | Beall | |
| 4,923,702 | A | 5/1990 | Powell et al. | |
| 5,246,106 | A * | 9/1993 | Johnson | A47G 33/002 206/217 |
| 7,426,994 | B2 * | 9/2008 | Simmons | B65D 25/20 206/217 |
| 8,061,545 | B2 * | 11/2011 | Roth | B65D 81/3205 206/217 |
| 10,442,595 | B2 * | 10/2019 | Grove | B65D 81/3216 |
| 2006/0016712 | A1 * | 1/2006 | Simmons | B65D 25/24 206/217 |

FOREIGN PATENT DOCUMENTS

| | | | |
|---|---|---|---|
| JP | 2015-155320 | A | 8/2015 |
| KR | 10-2099226 | B1 | 7/1999 |
| KR | 10-2002-0031849 | A | 5/2002 |
| KR | 10-2009-0095069 | A | 9/2009 |
| KR | 20-0489571 | Y1 | 7/2019 |

OTHER PUBLICATIONS

Korea Office Action Request for Submission of opinion dated Jun. 13, 2023 for Korean Patent Application No. 10-2022-0128462.

International Search Report for PCT/KR2023/015383 dated Jan. 4, 2024 (PCT/ISA/210).

* cited by examiner

PACKAGING CONTAINER FOR BREAD AND WINE FOR COMMUNION THAT INCLUDES SANITARY STRUCTURE

CROSS REFERENCE TO RELATED APPLICATIONS

This application is a National Stage of International Application No. PCT/KR2023/015383 filed Oct. 6, 2023, claiming priority based on Korean Patent Application No. 10-2022-0128462 filed Oct. 7, 2022, the entire disclosures of which are incorporated herein by reference.

BACKGROUND

1. Field of the Invention

The present invention relates to a packaging container for bread and wine for Communion, and more particularly, to a packaging container for bread and wine for Communion that includes a structure capable of preventing the spread of infectious diseases and reducing the time taken to distribute the bread and wine.

2. Discussion of Related Art

Conventional Communion cups are no different from typical cups. Wine is poured into cups with an open upper portion, and bread for Communion is separately distributed to hold Communion.

Specifically, a plurality of cups filled with wine and a plurality of pieces of bread are placed on a tray member as illustrated in FIG. 1*a* and distributed to participants of Communion. As illustrated in FIG. 1*b*, the participants each take one of the plurality of cups filled with wine and drink the wine.

However, in this case, since the wine and bread for Communion are exposed to the air, there is a risk of the spread of an infectious disease among the participants during Communion.

In order to address such a problem, a separately packaged container illustrated in FIG. 1*c* is provided to each participant in some cases, but there is a problem in that a large amount of waste is generated after Communion.

Also, in order to address the above problem, a disposable Communion cup that is pre-filled with wine and has a plastic cover adhered thereto using an adhesive as illustrated in FIG. 1*d* has been released. However, there is still a problem in that a large amount of waste is generated after Communion, and there is a problem in that the wine may splash out of the cup in a process of opening the plastic cover adhered using the adhesive.

Therefore, there is a need for technology that can address the above-mentioned problems of the related art.

RELATED ART DOCUMENT

Patent Document (Patent Document 0001) Korean Unexamined Patent Application Publication No. 10-2002-0031849 (Date of Publication: May 3, 2002)

SUMMARY OF THE INVENTION

The present invention is directed to a packaging container for bread and wine for Communion that includes a structure capable of preventing a risk of the spread of infectious diseases among participants during Communion due to bread and wine for Communion being exposed to the air and capable of significantly reducing the time taken to distribute the bread and wine for Communion.

According to an aspect of the present invention, there is provided a packaging container for bread and wine for Communion, the packaging container including: a first storage portion which has a structure forming a storage space of a predetermined volume in which wine is able to be stored and having an open upper surface, has a cylindrical structure having an outer diameter gradually increasing upward, has an antibacterial film containing a copper component coated on an outer surface, and has a sanitary wipe storage portion formed at a lower surface to store a sanitary wipe which is able to be easily withdrawn and utilized by being gripped by a user's fingers; a second storage portion which is rotatably mounted on the upper surface of the first storage portion, has a cylindrical structure having the same outer diameter as the upper surface of the first storage portion, has a structure forming a storage space of a predetermined volume in which bread is able to be stored and having an open upper surface, has a sanitary opening made of an antibacterial film material, which is able to be easily removed by being gripped by the user's fingers, mounted on the open upper surface, and has the antibacterial film containing the copper component coated on an outer circumferential surface; a first sealing film in the form of a transparent thin film that is mounted to seal the upper surface of the second storage portion and made of an elastic material having a predetermined elastic restoring force; a second sealing film in the form of a thin film that is mounted to seal a lower surface of the second storage portion and made of the elastic material having the predetermined elastic restoring force; a first tearing portion which is mounted in an upper portion of the second storage portion and configured to be moved due to the second storage portion rotating a first angle and tear the first sealing film; and a second tearing portion which is mounted in a lower portion of the second storage portion and configured to be moved due to the second storage portion further rotating a second angle after rotating the first angle and tear the second sealing film.

In one embodiment of the present invention, the first sealing film may be continuously mounted at a predetermined depth in a first groove having a ring structure formed at an inner circumferential surface of an upper end of the second storage portion and may be torn due to the movement of the first tearing portion and come in close contact with an inner portion of the first groove to open the upper surface of the second storage portion.

Also, the second sealing film may be continuously mounted at a predetermined depth in a second groove having a ring structure formed at an inner circumferential surface of a lower end of the second storage portion and may be torn due to the movement of the second tearing portion and come in close contact with an inner portion of the second groove to open the lower surface of the second storage portion.

In this case, the first tearing portion may be a needle-shaped structure mounted adjacent to the first groove and in the upper portion of the second storage portion and configured to rotate along with the rotation of the second storage portion, pierce through one side of the first sealing film, and tear the first sealing film.

Also, the second tearing portion may be a needle-shaped structure mounted adjacent to the second groove and in the lower portion of the second storage portion and configured to rotate along with the rotation of the second storage portion, pierce through one side of the second sealing film, and tear the second sealing film.

In one embodiment of the present invention, the first storage portion and the second storage portion may be structures that are able to be assembled to and disassembled from each other.

In this case, the first sealing film may be mounted as a structure that is able to be attached to and detached from the upper portion of the second storage portion, and the second sealing film may be mounted as a structure that is able to be attached to and detached from the lower portion of the second storage portion.

In addition, the first storage portion and the second storage portion may be made of a metal material that is able to be disinfected at a high temperature using an external heat source.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION OF EXEMPLARY EMBODIMENTS

Hereinafter, exemplary embodiments of the present invention will be described in detail with reference to the accompanying drawings. Prior to the description, it should be noted that the terms or words used in the present specification and the claims should not be interpreted as being limited to their general or dictionary meanings and should be interpreted as having meanings and concepts consistent with the technical spirit of the present invention.

Throughout the specification, when a certain member is described as being positioned "on" another member, this not only includes a case where the certain member is in contact with the other member but also includes a case where another member is present between the two members. Throughout the specification, when a certain portion is described as "including" a certain component, this does not mean that other components are excluded unless particularly described otherwise, and the certain portion may further include other components.

Figure 1:
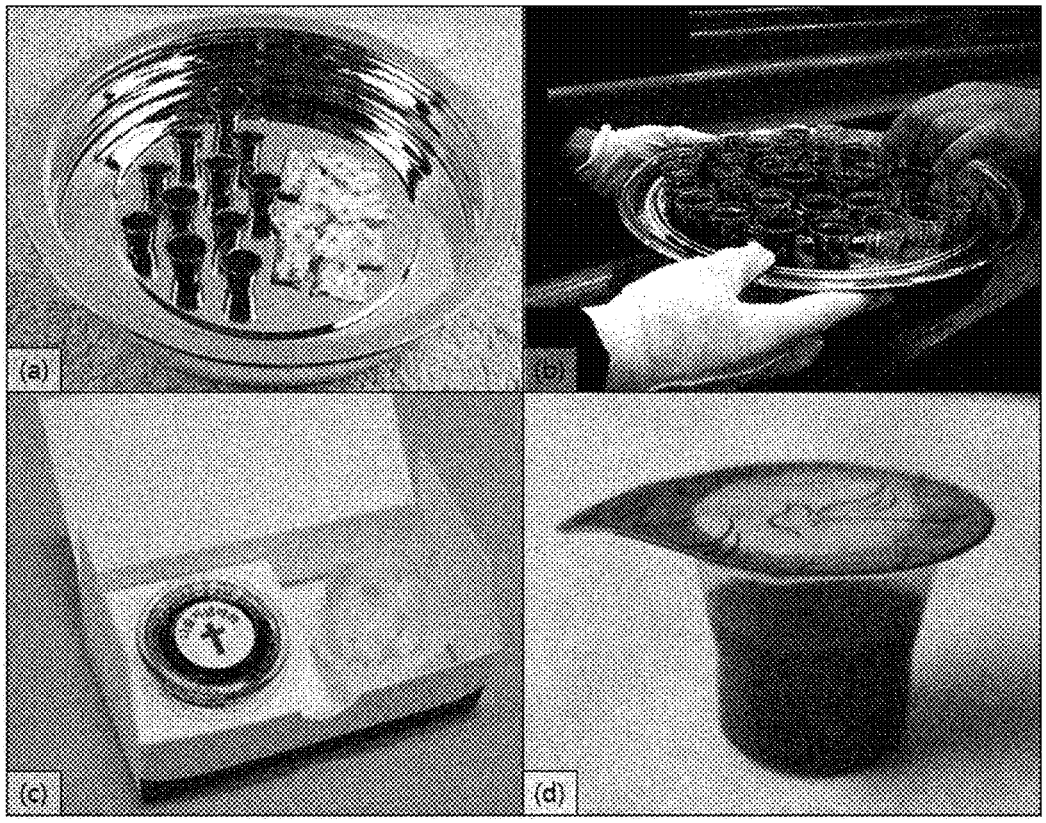
FIG. 1*a-d* show pictures of storage containers for bread and wine for Communion according to the related art.
Figure 2:
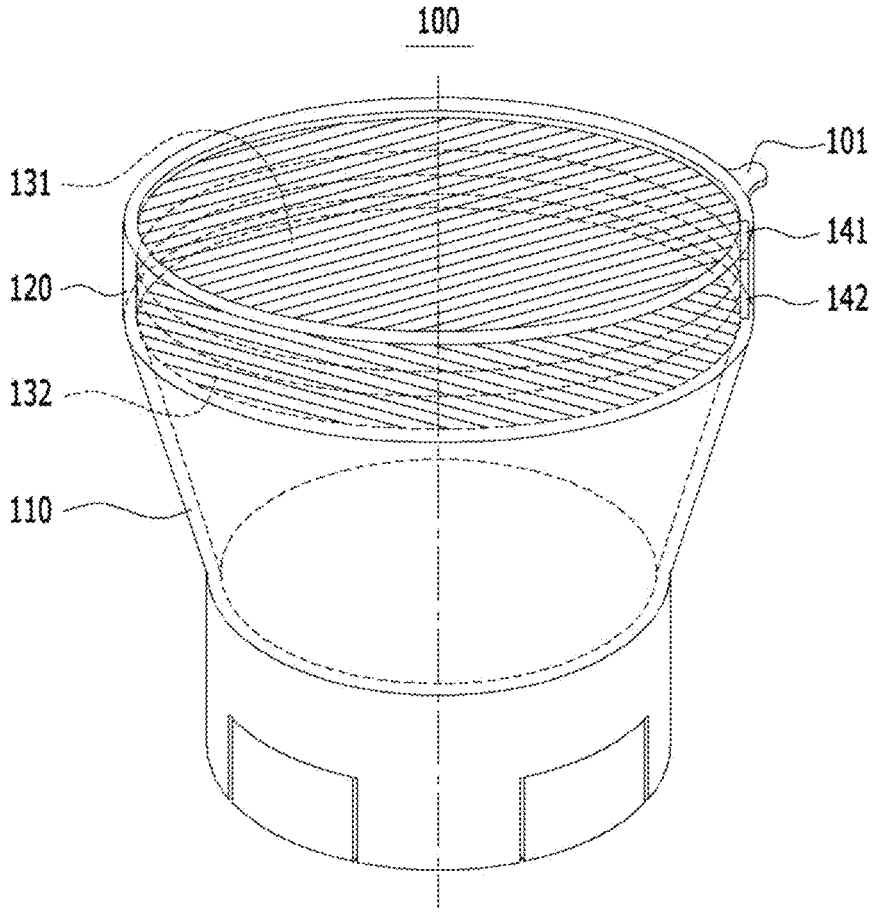
FIG. 2 is a perspective view of a packaging container for bread and wine for Communion according to one embodiment of the present invention.
Figure 3:
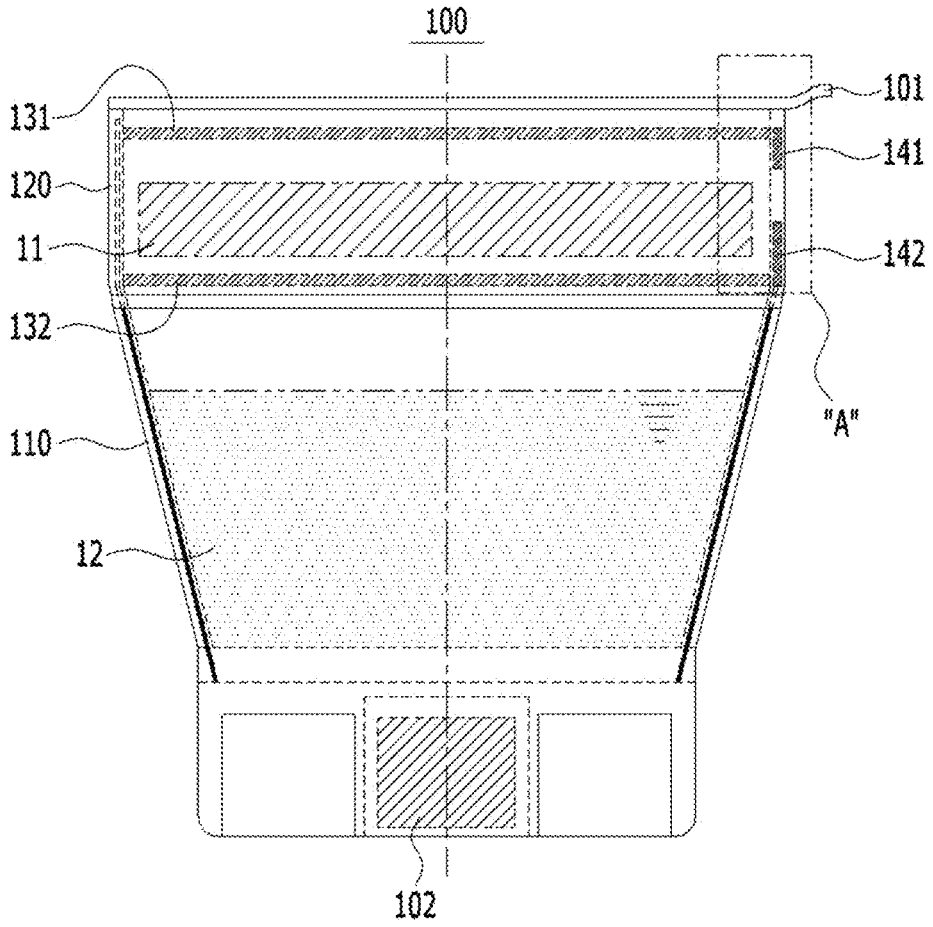
FIG. 3 is a front see-through view of the packaging container for bread and wine for Communion that is illustrated in FIG. 2.

FIG. 2 is a perspective view of a packaging container for bread and wine for Communion according to one embodiment of the present invention, and FIG. 3 is a front see-through view of the packaging container for bread and wine for Communion that is illustrated in FIG. 2.

Referring to FIGS. 2 and 3, in a packaging container 100 for bread and wine for Communion according to the present embodiment, a first storage portion 110, a second storage portion 120, a first sealing film 131, a second sealing film 132, a first tearing portion 141, and a second tearing portion 142 each having a specific structure are provided. Accordingly, it is possible to provide a packaging container for bread and wine for Communion that includes a structure capable of preventing a risk of the spread of infectious diseases among participants during Communion due to bread and wine for Communion being exposed to the air and capable of significantly reducing the time taken to distribute the bread and wine for Communion.

Hereinafter, each component constituting the packaging container 100 for bread and wine for Communion according to the present embodiment will be described in detail.

Figure 4:
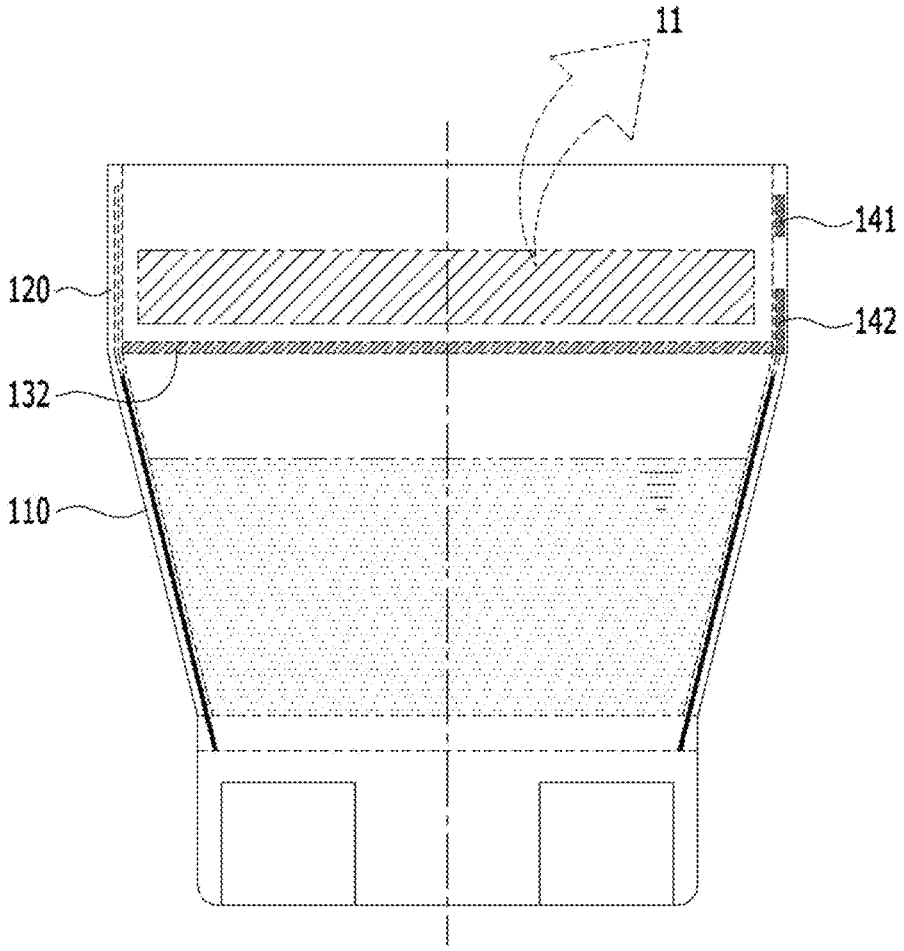
FIG. 4 is a front see-through view of a state in which a first sealing film of the packaging container for bread and wine for Communion that is illustrated in FIG. 3 is torn.
Figure 5:
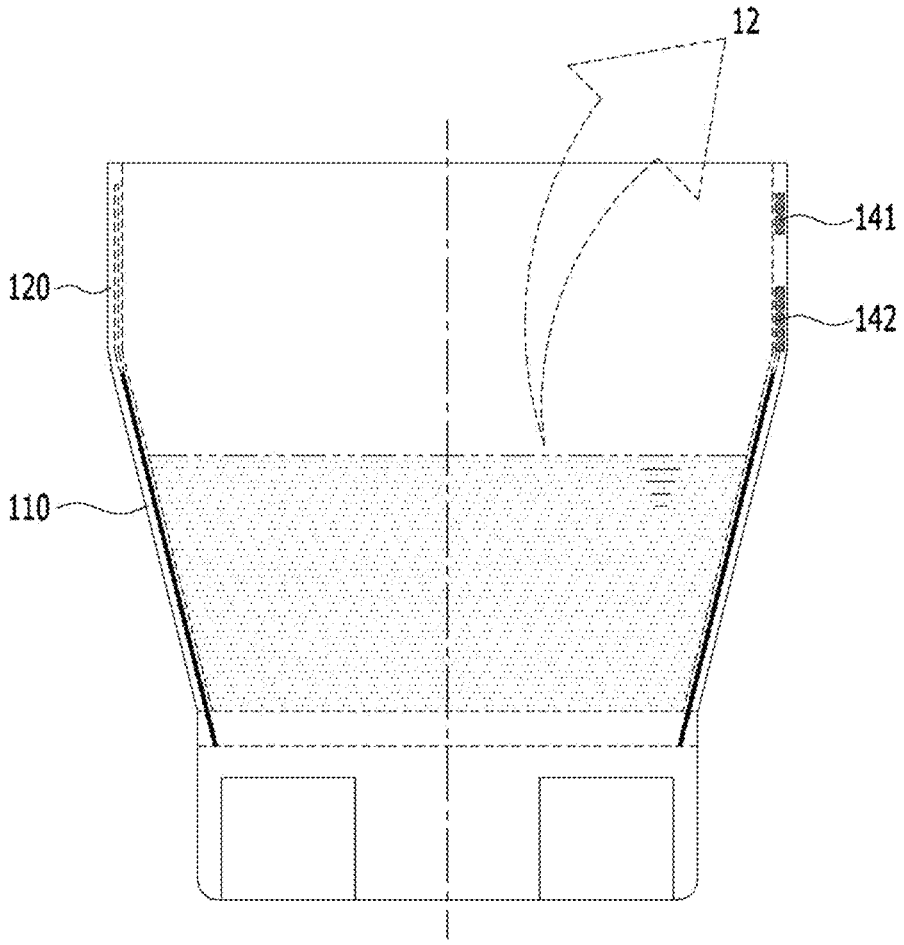
FIG. 5 is a front see-through view of a state in which a second sealing film of the packaging container for bread and wine for Communion that is illustrated in FIG. 4 is torn.
Figure 6:
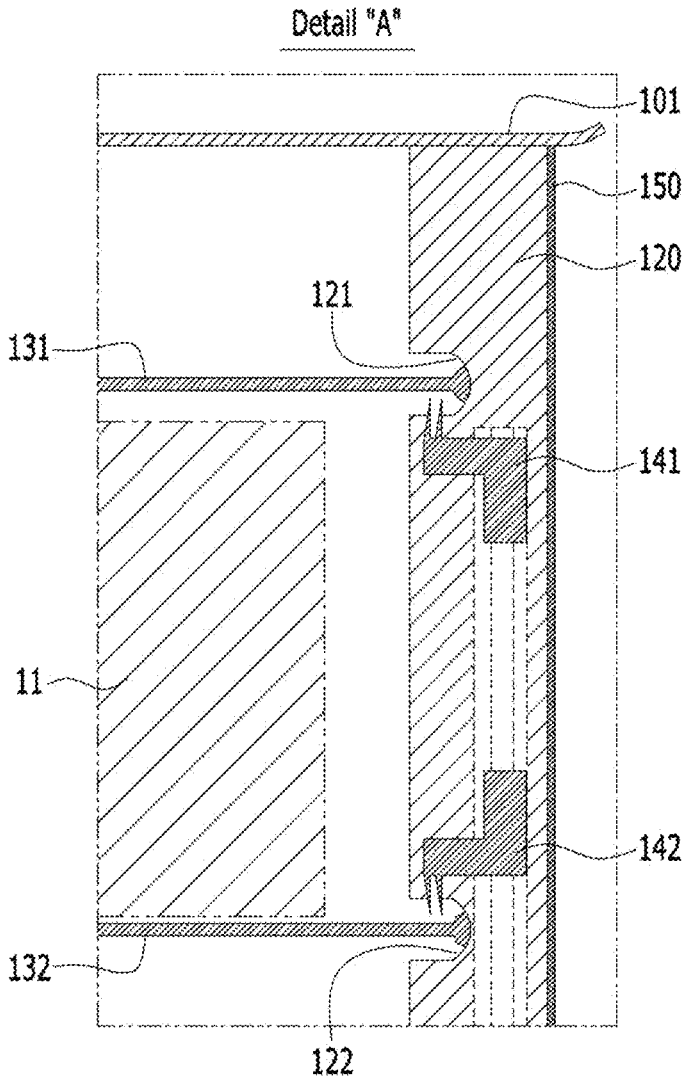
FIG. 6 is an enlarged view of portion A of FIG. 3.
Figure 7:
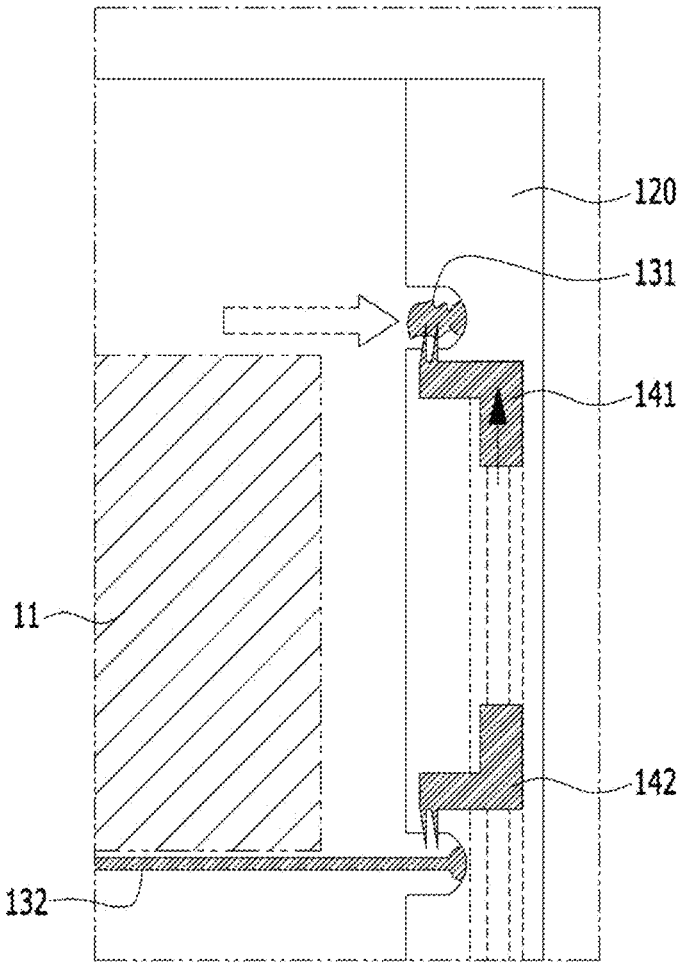
FIG. 7 is an enlarged view of a state in which the first sealing film is torn due to an operation of a first tearing portion of FIG. 6.
Figure 8:
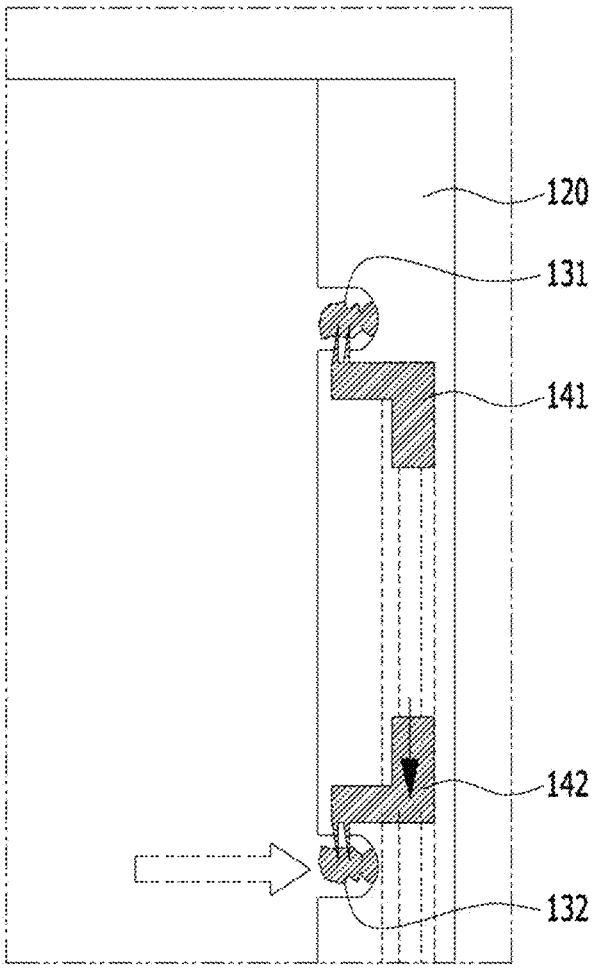
FIG. 8 is an enlarged view of a state in which the second sealing film is torn due to an operation of a second tearing portion of FIG. 7.

FIG. 4 is a front see-through view of a state in which the first sealing film of the packaging container for bread and wine for Communion that is illustrated in FIG. 3 is torn, and FIG. 5 is a front see-through view of a state in which the second sealing film of the packaging container for bread and wine for Communion that is illustrated in FIG. 4 is torn. Also, FIG. 6 is an enlarged view of portion A of FIG. 3, FIG. 7 is an enlarged view of a state in which the first sealing film is torn due to an operation of the first tearing portion of FIG. 6, and FIG. 8 is an enlarged view of a state in which the second sealing film is torn due to an operation of the second tearing portion of FIG. 7.

Referring to FIGS. 2 to 8, the first storage portion 110 of the packaging container 100 for bread and wine for Communion according to the present embodiment has a structure forming a storage space of a predetermined volume in which wine is able to be stored and having an open upper surface, has a cylindrical structure having an outer diameter gradually increasing upward, and has an antibacterial film 150 containing a copper component coated on an outer surface. Also, a sanitary wipe storage portion 102 configured to store a sanitary wipe which is able to be easily withdrawn and utilized by being gripped by a user's fingers may be formed at a lower surface of the first storage portion 110. The sanitary wipe stored in the sanitary wipe storage portion 102 may contain a disinfectant that allows the user's fingers or hand to be disinfected while being wiped off.

The second storage portion 120 of the packaging container 100 for bread and wine for Communion according to the present embodiment is rotatably mounted on the upper surface of the first storage portion 110, has a cylindrical structure having the same outer diameter as the upper surface of the first storage portion 110, has a structure forming a storage space of a predetermined volume in which bread is able to be stored and having an open upper surface, and has the antibacterial film 150 containing the copper component coated on an outer circumferential surface.

Also, a sanitary opening 101 made of an antibacterial film material, which is able to be easily removed by being gripped by the user's fingers, may be mounted on the open upper surface of the second storage portion 120 according to the present embodiment. A protrusion that protrudes a predetermined length toward a side of the sanitary opening 101 and can be easily gripped by the user's fingers may be formed at the sanitary opening 101, and the user may easily remove the sanitary opening 101 by holding the protrusion and tearing off the protrusion upward. According to circumstances, a perforation line may be formed in the protrusion gripped by the fingers, and when the protrusion is gripped by the fingers and moved upward, the protrusion may be torn with a clicking sound or vibration.

The first sealing film 131 of the packaging container 100 for bread and wine for Communion according to the present embodiment is in the form of a transparent thin film that is mounted to seal the upper surface of the second storage portion 120 and made of an elastic material having a predetermined elastic restoring force.

The second sealing film 132 of the packaging container 100 for bread and wine for Communion according to the present embodiment is in the form of a thin film that is mounted to seal a lower surface of the second storage portion 120 and made of the elastic material having the predetermined elastic restoring force.

Specifically, as illustrated in FIGS. 6 and 7, the first sealing film 131 is continuously mounted at a predetermined depth in a first groove 121 having a ring structure formed at an inner circumferential surface of an upper end of the second storage portion 120 and is torn due to the movement of the first tearing portion 141 and comes in close contact with an inner portion of the first groove 121 to open the upper surface of the second storage portion 120.

Also, as illustrated in FIGS. 6 and 8, the second sealing film 132 is continuously mounted at a predetermined depth in a second groove 122 having a ring structure formed at an inner circumferential surface of a lower end of the second storage portion 120 and is torn due to the movement of the second tearing portion 142 and comes in close contact with an inner portion of the second groove 122 to open the lower surface of the second storage portion 120.

The first tearing portion 141 according to the present embodiment may be mounted in an upper portion of the second storage portion 120 and moved due to the second storage portion 120 rotating a first angle, and may tear the first sealing film 131.

The second tearing portion 142 according to the present embodiment may be mounted in a lower portion of the second storage portion 120 and moved due to the second storage portion 120 further rotating a second angle after rotating the first angle, and may tear the second sealing film 132.

Specifically, as illustrated in FIGS. 6 to 8, the first tearing portion 141 is a needle-shaped structure mounted adjacent to the first groove 121 and in the upper portion of the second storage portion 120 and configured to rotate along with the rotation of the second storage portion 120, pierce through one side of the first sealing film 131, and tear the first sealing film 131. Also, the second tearing portion 142 is a needle-shaped structure mounted adjacent to the second groove 122 and in the lower portion of the second storage portion 120 and configured to rotate along with the rotation of the second storage portion 120, pierce through one side of the second sealing film 132, and tear the second sealing film 132.

Meanwhile, the first storage portion 110 and the second storage portion 120 according to the present embodiment are structures that are able to be assembled to and disassembled from each other, the first sealing film 131 is mounted as a structure that is able to be attached to and detached from the upper portion of the second storage portion 120, and the second sealing film 132 is mounted as a structure that is able to be attached to and detached from the lower portion of the second storage portion 120.

Here, the first storage portion 110 and the second storage portion 120 may be made of a metal material that is able to be disinfected at a high temperature using an external heat source.

As described above, according to the packaging container for bread and wine for Communion of the present invention, since the first storage portion 110, the second storage portion 120, the first sealing film 131, the second sealing film 132, the first tearing portion 141, and the second tearing portion 142 each having a specific structure are provided, it is possible to provide a packaging container for bread and wine for Communion that includes a structure capable of preventing a risk of the spread of infectious diseases among participants during Communion due to bread and wine for Communion being exposed to the air and capable of significantly reducing the time taken to distribute the bread and wine for Communion.

Also, according to the packaging container for bread and wine for Communion of the present invention, since the first storage portion 110 and the second storage portion 120 are made of a metal material that can be disinfected at a high temperature using an external heat source, and the first sealing film 131 and the second sealing film 132 can be easily replaced, the container itself storing the bread and wine for Communion can be safely disinfected and reused.

As described above, according to a packaging container for bread and wine for Communion of the present invention, since a first storage portion, a second storage portion, a first sealing film, a second sealing film, a first tearing portion, and a second tearing portion each having a specific structure are provided, it is possible to provide a packaging container for bread and wine for Communion that includes a structure capable of preventing a risk of the spread of infectious diseases among participants during Communion due to bread and wine for Communion being exposed to the air and capable of significantly reducing the time taken to distribute the bread and wine for Communion.

Also, according to the packaging container for bread and wine for Communion of the present invention, since the first storage portion and the second storage portion are made of a metal material that can be disinfected at a high temperature using an external heat source, and the first sealing film and the second sealing film can be easily replaced, the container itself storing the bread and wine for Communion can be safely disinfected and reused.

Only some particular embodiments according to the present invention have been described in the above detailed description of the present invention. However, the present invention should not be understood as being limited to the particular forms mentioned in the detailed description and should rather be understood as including all modifications, equivalents, and substitutes within the spirit and scope of the present invention defined by the appended claims.

That is, the present invention is not limited to the specific embodiments described above, those of ordinary skill in the art to which the present invention pertains may make various modifications without departing from the gist of the present invention claimed in the claims, and such modifications also belong to the protection scope of the present invention.

What is claimed is:

1. A packaging container for bread and wine for Communion, the packaging container comprising:

a first storage portion (110) which has a structure forming a storage space of a predetermined volume in which wine is able to be stored and having an open upper surface, has a cylindrical structure having an outer diameter gradually increasing upward, has an antibacterial film (150) containing a copper component coated on an outer surface, and has a sanitary wipe storage portion (102) formed at a lower surface to store a sanitary wipe which is able to be easily withdrawn and utilized by being gripped by a user's fingers;

a second storage portion (120) which is rotatably mounted on the upper surface of the first storage portion (110), has a cylindrical structure having the same outer diameter as the upper surface of the first storage portion (110), has a structure forming a storage space of a predetermined volume in which bread is able to be stored and having an open upper surface, has a sanitary opening (101) made of an antibacterial film material, which is able to be easily removed by being gripped by the user's fingers, mounted on the open upper surface, and has the antibacterial film (150) containing the copper component coated on an outer circumferential surface;

a first sealing film (131) in the form of a transparent thin film that is mounted to seal the upper surface of the second storage portion (120) and made of an elastic material having a predetermined elastic restoring force;

a second sealing film (132) in the form of a thin film that is mounted to seal a lower surface of the second storage portion (120) and made of the elastic material having the predetermined elastic restoring force;

a first tearing portion (141) which is mounted in an upper portion of the second storage portion (120) and configured to be moved due to the second storage portion (120) rotating a first angle and tear the first sealing film (131); and a second tearing portion (142) which is mounted in a lower portion of the second storage portion (120) and configured to be moved due to the second storage portion (120) further rotating a second angle after rotating the first angle and tear the second sealing film (132).

2. The packaging container of claim 1, wherein:

the first sealing film (131) is continuously mounted at a predetermined depth in a first groove (121) having a ring structure formed at an inner circumferential surface of an upper end of the second storage portion (120) and is torn due to the movement of the first tearing portion (141) and comes in close contact with an inner portion of the first groove (121) to open the upper surface of the second storage portion (120); and the second sealing film (132) is continuously mounted at a predetermined depth in a second groove (122) having a ring structure formed at an inner circumferential surface of a lower end of the second storage portion (120) and is torn due to the movement of the second tearing portion (142) and comes in close contact with an inner portion of the second groove (122) to open the lower surface of the second storage portion (120).

3. The packaging container of claim 2, wherein:

the first tearing portion (141) is a needle-shaped structure mounted adjacent to the first groove (121) and in the upper portion of the second storage portion (120) and configured to rotate along with the rotation of the second storage portion (120), pierce through one side of the first sealing film (131), and tear the first sealing film (131); and the second tearing portion (142) is a needle-shaped structure mounted adjacent to the second groove (122) and in the lower portion of the second storage portion (120) and configured to rotate along with the rotation of the second storage portion (120), pierce through one side of the second sealing film (132), and tear the second sealing film (132).

4. The packaging container of claim 1, wherein:

the first storage portion (110) and the second storage portion (120) are structures that are able to be assembled to and disassembled from each other;

the first sealing film (131) is mounted as a structure that is able to be attached to and detached from the upper portion of the second storage portion (120);

the second sealing film (132) is mounted as a structure that is able to be attached to and detached from the lower portion of the second storage portion (120); and the first storage portion (110) and the second storage portion (120) are made of a metal material that is able to be disinfected at a high temperature using an external heat source.

* * * * *